United States Patent [19]

Erdman

[11] Patent Number: 4,457,692

[45] Date of Patent: Jul. 3, 1984

[54] DUAL FIRING RATE FLAME SENSING SYSTEM

[75] Inventor: John L. Erdman, Bloomington, Minn.

[73] Assignee: Honeywell Inc., Minneapolis, Minn.

[21] Appl. No.: 525,082

[22] Filed: Aug. 22, 1983

[51] Int. Cl.[3] ..... F23N 3/00

[52] U.S. Cl. ..... 431/19; 431/20; 431/31; 431/46; 431/63; 431/77

[58] Field of Search ..... 431/19, 20, 25, 31, 431/46, 50, 59, 63, 77

[56] References Cited

U.S. PATENT DOCUMENTS

| | | | |
|---|---|---|---|
| 2,684,115 | 7/1954 | Cairns | 431/25 |
| 2,705,296 | 3/1955 | Weber | 431/25 |
| 4,421,268 | 12/1983 | Bassett et al. | 431/20 |

*Primary Examiner*—Carroll B. Dority, Jr.
*Attorney, Agent, or Firm*—Alfred N. Feldman

[57] ABSTRACT

A flame rod inserted in a flame created by the secondary air supplied to a burner is used to generate a flame signal voltage. This flame signal voltage fluctuates with the amount of secondary air available and with the fuel supplied. These fluctuations are relied upon by an integrated control system that utilizes a microprocessor or microcomputer to safely control an induced draft-type of furnace.

10 Claims, 4 Drawing Figures

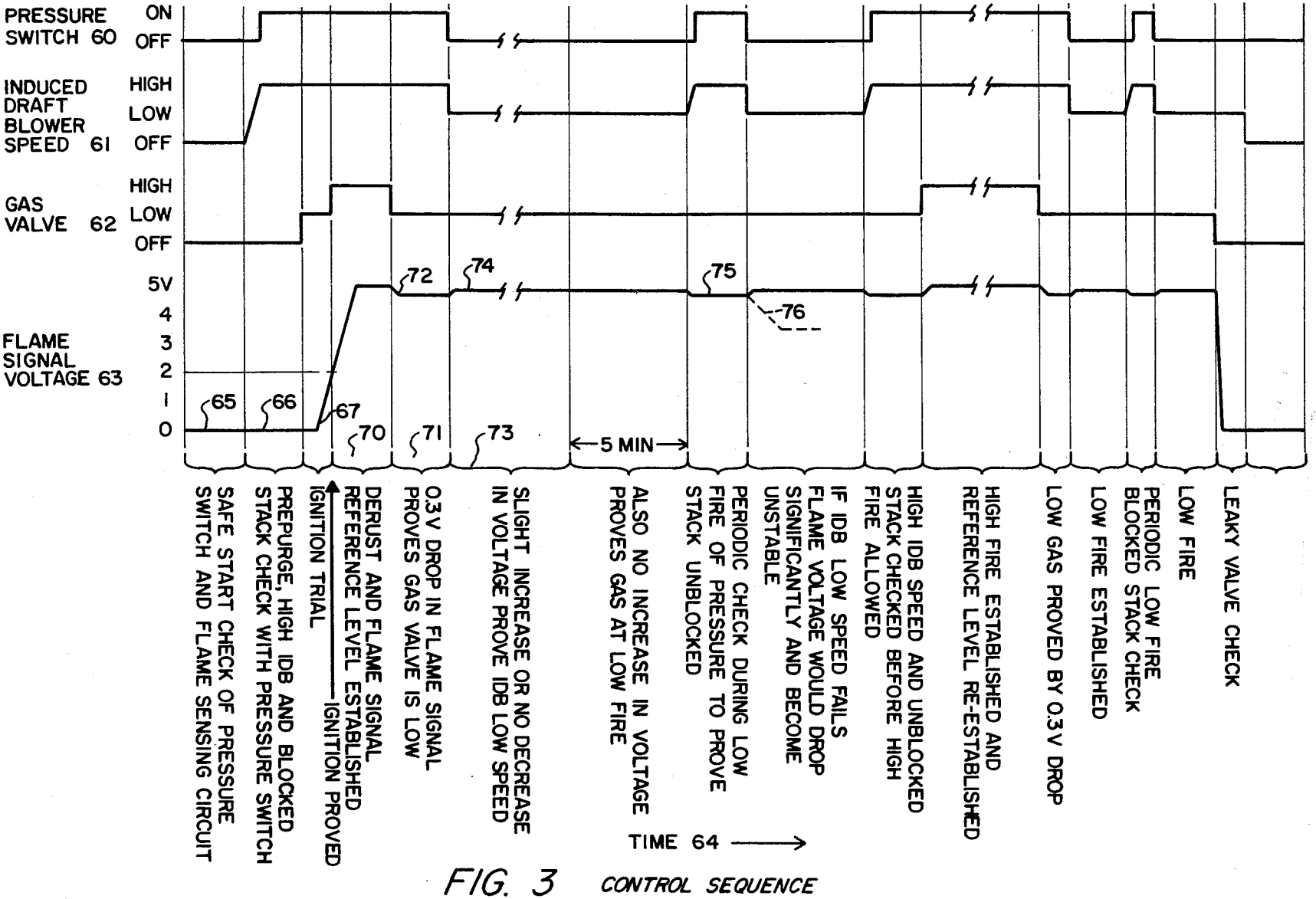
FIG. 3 CONTROL SEQUENCE

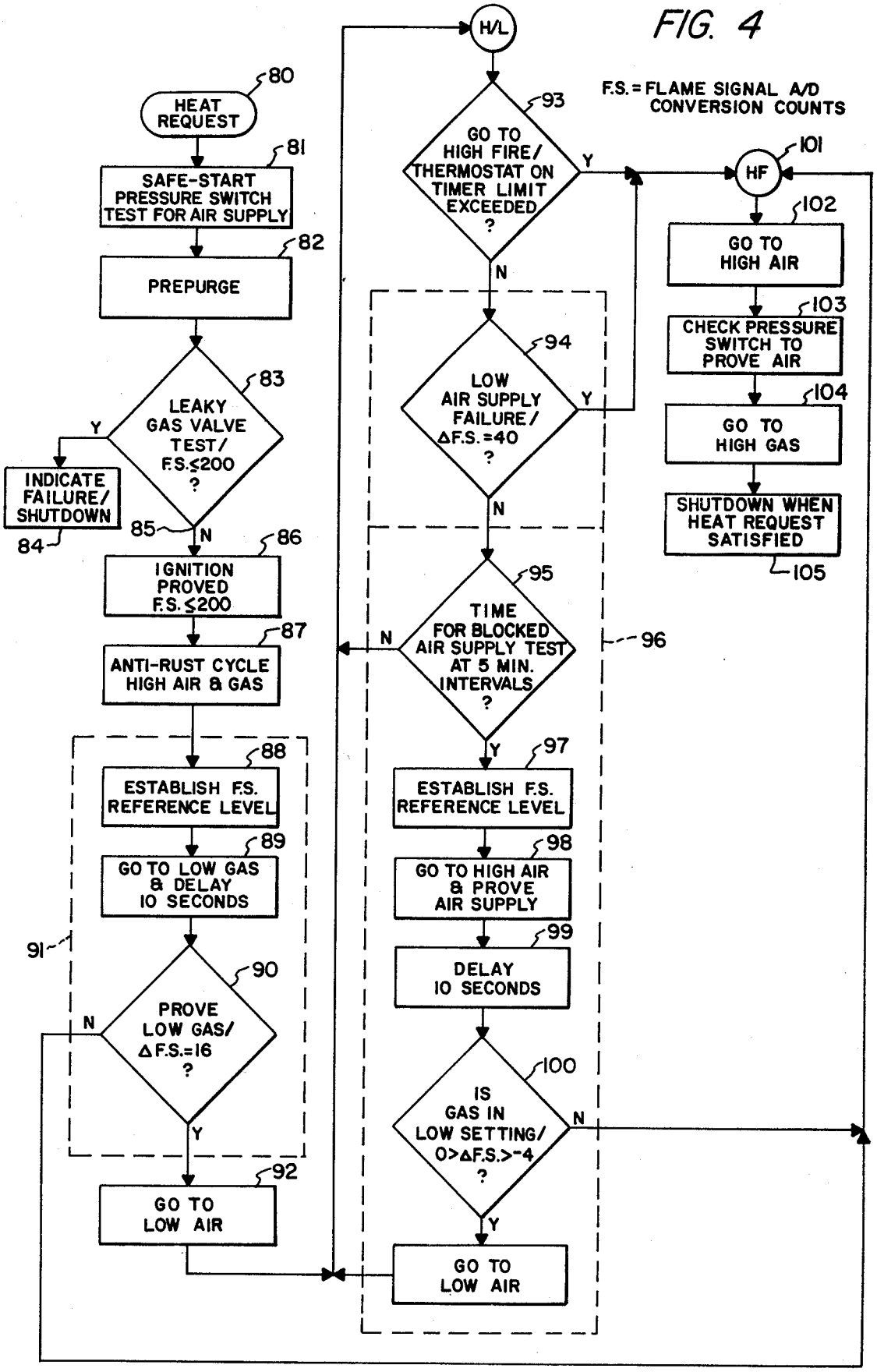
FIG. 4
F.S. = FLAME SIGNAL A/D CONVERSION COUNTS
HEAT REQUEST
80
SAFE-START PRESSURE SWITCH TEST FOR AIR SUPPLY
81
PREPURGE
82
LEAKY GAS VALVE TEST/ F.S.≤200 ?
83
Y
INDICATE FAILURE/ SHUTDOWN
84
85
N
IGNITION PROVED F.S.≤200
86
ANTI-RUST CYCLE HIGH AIR & GAS
87
ESTABLISH F.S. REFERENCE LEVEL
88
GO TO LOW GAS & DELAY 10 SECONDS
89
91
PROVE LOW GAS/ ΔF.S.=16 ?
90
N
Y
GO TO LOW AIR
92
H/L
GO TO HIGH FIRE/ THERMOSTAT ON TIMER LIMIT EXCEEDED ?
93
Y
N
LOW AIR SUPPLY FAILURE/ ΔF.S.=40 ?
94
Y
N
TIME FOR BLOCKED AIR SUPPLY TEST AT 5 MIN. INTERVALS ?
95
N
96
Y
ESTABLISH F.S. REFERENCE LEVEL
97
GO TO HIGH AIR & PROVE AIR SUPPLY
98
DELAY 10 SECONDS
99
IS GAS IN LOW SETTING/ 0>ΔF.S.>-4 ?
100
N
Y
GO TO LOW AIR
HF
101
GO TO HIGH AIR
102
CHECK PRESSURE SWITCH TO PROVE AIR
103
GO TO HIGH GAS
104
SHUTDOWN WHEN HEAT REQUEST SATISFIED
105

DUAL FIRING RATE FLAME SENSING SYSTEM

BACKGROUND OF THE INVENTION

In an effort to improve the efficiency of gas fired furnaces, induced draft blower types of furnaces utilizing a two-stage gas valve and an induced draft blower have been utilized. This type of furnace matches its heat output more closely to the heating demand of the residence being heated, and as such is more efficient than the older types of gravity draft-type furnaces.

In an effort to match the heat supplied from the furnace to the demand of the residence, a two-stage gas valve is operated at two different flow rates, and an induced draft blower is operated at two different speeds. This type of system has been operated with a control system that senses many parameters including the pressure within the combination chamber, the induced draft blower speed, and a signal to the gas valve to control it through its two-stage operation. This type of system is controlled by a microcomputer or microprocessor and is known as an integrated control system. These systems have been more efficient than the older types of furnace control systems, but certain safety considerations are required of the induced draft systems that are not significant in the older gravity draft-type systems.

These safety considerations are such as whether the gas valve in fact is functioning properly or is leaking, whether the induced draft blower is in fact operating at its proper speeds, and further whether or not the stack has become blocked due to some type of obstruction.

SUMMARY OF THE INVENTION

The present invention relates to an integrated control system for a two-stage, gas-fired type of furnace utilizing an induced draft blower having two different blower speeds.

It has been found that if a flame rod is utilized as a flame sensing means, that the flame rod can provide a unique signal output if the flame rod is placed in the outer cone of flame of the burner where the flame intensity is a function of the secondary or induced draft air through the burner. Normally, a flame rod is placed in the inner cone of a flame and is responsive to the gas burning with the primary air being induced by the introduction of the gas to the burner itself. In the prior devices where the flame rod is placed in the inner cone, and is responsive to the flame generated by the primary air flow and gas mixture, the flame rod's output signal has little or no variation with the secondary air flow through the furnace.

In the present invention, the flame rod is placed in the flame that is responsive to the secondary air and has an output signal which varies with air flow. While the basic phenomena of a flame rod responding to a flame is well known, the response of a flame rod to secondary air has not been previously recognized.

In the present invention, a complete flame sensing system for a furnace is provided and is disclosed along with an integrated control system that is operated by a microprocessor or microcomputer based electronic control.

In accordance with the present invention, there is provided a flame sensing system adapted to control a fuel burner in a furnace which includes a variable source of fuel, and air source means providing a primary air flow and a secondary air flow for said fuel burner, including: a flame rod positioned to be in an outer area of a flame present at said burner when said burner is in operation; flame sensing circuit means adapted to be energized by a source of voltage; and said flame sensing circuit means connected to said flame rod and said burner to provide a flame rectified sensing signal that varies with the rate of fuel being burned and with said secondary flow.

In addition, in accordance with the present invention, there is also provided a flame sensing system adapted to control a fuel burner in a furnace which includes a variable source of fuel, and air source means providing a primary air flow and a secondary air flow for said fuel burner, including: a flame rod positioned to be in an outer area of a flame present at said burner when said burner is in operation; flame sensing circuit means adapted to be energized by a source of voltage; said flame sensing circuit means connected to said flame rod and said burner to provide a flame rectified sensing signal that varies with the rate of fuel being burned and with said secondary flow; and integrated furnace control system means connected to said flame sensing circuit, said variable source of fuel, and said air source means to control said fuel burner, in part, in response to said flame rectified sensing signal.

DESCRIPTION OF THE DRAWINGS

FIG. 3 is a graph of four functions in the system verses time, and;

FIG. 4 is a flowchart of the operation of a typical integrated control system as described in FIG. 3.

DESCRIPTION OF THE PREFERRED EMBODIMENTS

Figure 1:
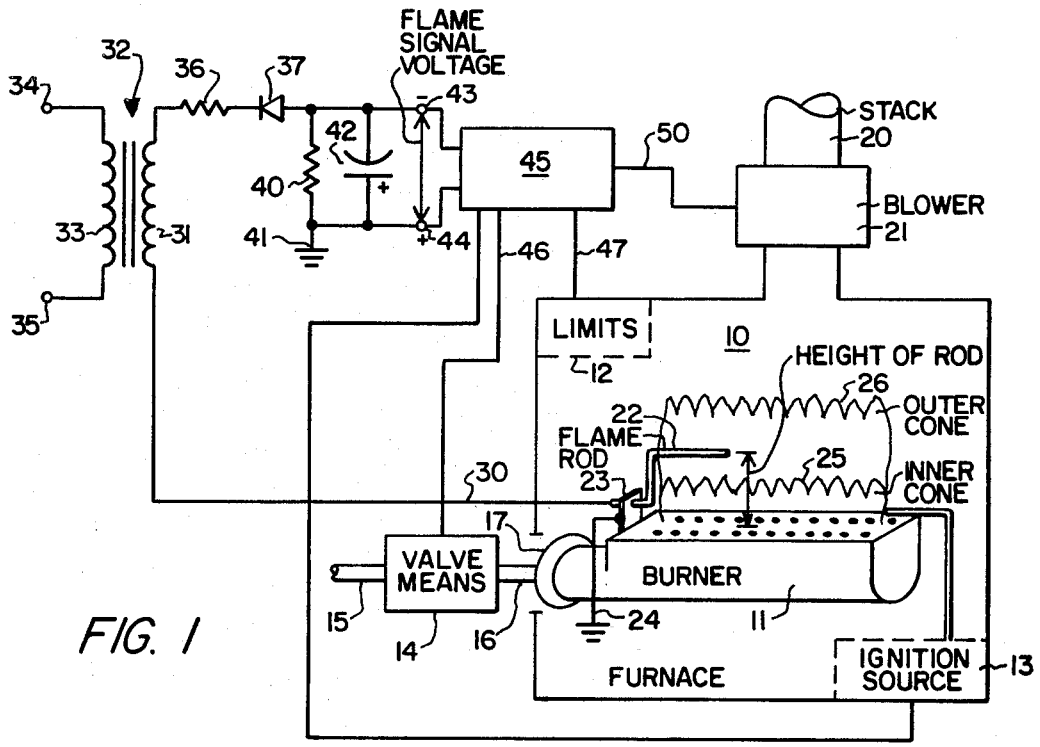
FIG. 1 is a pictorial representation of a burner connected to an integrated control system.

In FIG. 1, there is generally disclosed at 10 an induced draft-type of furnace which has a burner 11, limits 12, an ignition source 13, and a valve means 14. The valve means 14 is connected to a source of gas or fuel 15 and in turn has an output 16 to the burner 11 where the fuel induces air into an intake cone 17 of the burner 11 to produce a primary flame at the burner.

Mounted in a stack 20 of the furnace 10 is a two-spaced blower 21 that provides an induced draft for the burner 10 to provide a low speed of operation which draws air into the furnace when the valve means 14 is also set for a low input of fuel. The blower 21 has a second or high speed that provides a much higher air flow for a valve setting of valve means 14 where a substantially higher amount of fuel is introduced into the burner 11.

Mounted at the burner 11 is a flame rod 22 that is mounted by a mounting bracket 23 on the burner 11. The burner 11 and the bracket 23 are grounded electrically to the furnace at 24. The bracket 23 electrically isolates itself from the flame rod 22 so that the flame rod electrically is independent of the ground 24.

The burner 11, in FIG. 1, is shown having an inner cone of flame 25 and an outer cone of flame 26. The inner cone of flame 25 is the normal blue-colored flame that is a function primarily of the fuel being supplied via pipe 16 and the air being induced through the intake cone 17, and is referred to as the primary flame for the device. Normally in prior devices, when a flame rod is used, it is placed in the inner cone 25, and the output of the flame rod remains substantially unchanged when the height of the flame 26 of the outer cone varies. In the present invention, the flame rod 22 is placed in the outer cone 26 of the flame, and this flame intensity does vary with the amount of fuel being supplied through the fuel valve 14 and the speed of the blower 21. An output signal is provided on a conductor 30, and this conductor has an output signal that will be described in more detail in connection with FIG. 3. For the time being, it is sufficient to understand that the output signal on conductor 30 is a function of the height or intensity of the outer cone of flame 26, and this flame in turn is a function of the blower speed of blower 21 and the setting of the valve means 14.

The flame rod conductor 30 is connected to a transformer secondary 31 with the transformer secondary 31 being part of a transformer 32 having a primary 33 that is connected to any alternating current source by terminals 34 and 35. The secondary winding 31 is connected through a dropping resistor 36 and a diode 37 to a resistor 40 and a ground 41 which would electrically be connected with the ground 24. A summing capacitor 42 is placed across resistor 40 so that a flame rectified signal from the conductor 30 can be integrated and provided as a flame signal across the terminals 43 and 44. It will be noted that the diode 37 characterizes the direction of flow of current from the flame rod, and the summed current across the capacitor 42 has been indicated by a polarity sign. It will further be understood that the diode 37 is not essential to the operation of the circuit and may or may not be used. While the power supplied to the flame rod 22 is shown as from an alternating current voltage source, it is possible to use a direct current source between the flame rod 22 and ground 41. A direct current source, however, would have a more limited safety function in that certain types of faults would not be detectable by the integrated control system, later disclosed.

The flame signal from terminals 43 and 44 are connected to a microprocessor or minicomputer 45 that forms an integrated control system for the unit. The integrated control system 45 provides an output control on a conductor 46 to the valve means 14. The integrated control system 45 receives information on a conductor 47 from the limits 12. The limits 12 could be temperature limits, pressure switches, etc. as are typical in a furnace 10. The integrated control system 45 further has an output on a conductor 50 to control the blower 21. The integrated control system 45 has been shown only partially and is of conventional design. The control system would further include other inputs and outputs such as a control from a thermostat, limits, power, etc. and are not believed necessary for the understanding of the present invention.

The operation of the flame rod 22 in FIG. 1 will be briefly described at this point and described in more detail in connection with FIGS. 3 and 4. It will be understood that the flame rod 22 is placed in the outer cone 26 of the flame. The intensity of the outer cone 26 is a function of the amount of fuel being supplied by the fuel valve 14 and the speed of the blower 21. It has been found that with a low speed operation and a low setting of the valve 14, that the flame rod 22 has a voltage output on conductor 30 that is relatively small. If the fuel valve 14 is opened to a larger degree and the blower 21 set at its highest speed, the output voltage on conductor 30 increases significantly. These functions can be used to sense the quality of the burner operation. The quality also relates to the safety, since the quality of operation of the burner could indicate whether or not the stack 20 is blocked, whether the fuel valve 14 is fully opened or is leaking, etc. All of these functions will be detailed in connection with the graph of FIG. 3 wherein the flame current is correlated with a control sequence for a complete integrated control system 45.

Figure 2:
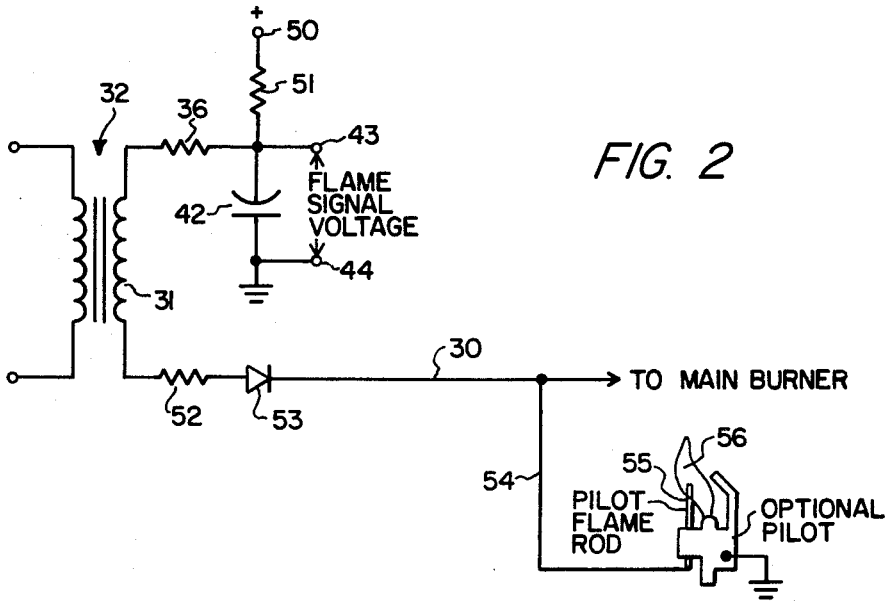
FIG. 2 is a burner system incorporating an optional pilot.

In FIG. 2, an addition to the system of FIG. 1 is disclosed wherein the transformer 32 is again disclosed with a secondary 31 and the resistor 36, capacitor 42, and terminals 43 and 44 for a flame signal output voltage. In this case, a source of voltage is also supplied at 50 through a resistor 51. A resistor 52 and an optional diode 53 are connected to the conductor 30. The conductor 30 is connected to the flame rod 22 (not shown) and to a further conductor 54 and a flame rod 55 that is placed in an optional pilot 56 which can be used in conjunction with the ignition source 13 or in place of the ignition source 13 for the burner 11. The use of an optional pilot 56 as disclosed in FIG. 2 merely is an extension of the present invention showing how it could be applied to a system that utilized a pilot 56 and a pilot flame rod 55.

In FIG. 3, a graph of four functions are plotted against time. The first function is a pressure switch ON/OFF function at 60 which corresponds to one of the limit means 12. The second function plotted is induced draft blower speeds 61, and it is plotted from an OFF condition, a low speed condition, and a high speed condition against time for the blower 21. The third function is the gas valve condition 62 which is plotted in an OFF condition, a low fire position, and a high fire position for the valve means 14. The last of the functions plotted is the flame signal voltage 63 which varies from zero volts to approximately five volts as measured at terminals 43 and 44 across the capacitor 42 of the system disclosed in FIG. 1. All of the functions 60, 61, 62, and 63 are plotted against time shown at 64 and start at a start sequence for the furnace 10. Each of the sequences, and their changes, are referenced by a text description along the time baseline to indicate the correct status of each of the functions with respect to time as controlled by the microprocessor or microcomputer 45 of FIG. 1. Only a few of the more pertinent points will be specifically referenced as it is believed that the text of FIG. 3 is basically self-explanatory.

At the start-up, the pressure switch signal 60, the induced draft blower speed signal 61, the gas valve signal 62, and the flame signal voltage 63 are all at a minimum value as indicated at 65. At 66, a prepurge, high induced draft blower and block stack check is initiated using the pressure switch wherein the sensed pressure must go from an OFF (or low) condition to an ON (or high) condition.

At 67, an ignition trial is instituted. This entails the gas valve function 62 going from an OFF to a low condition along with the presence of air pressure indicating that the blower is properly functioning. It will be noted that the flame signal voltage 63 at this time begins to arise from the zero voltage output towards approximately five volts. In the present system, a reset and flame signal reference test level 70 is established in which the gas valve function 62 is open to a high condition while the pressure switch signal 60 is high, and the induced draft blower signal 61 is also high. With this test condition 70, the flame signal should approach the five-volt level.

At 71, proof of the flame signal is provided by reducing the gas valve signal 62 from a high level to a low level at which time the flame signal voltage 63 drops at 72 by at least 0.3 volts indicating the change in gas valve status.

At 73, the system is put into its low fire state wherein the pressure switch function 60 drops to an OFF state, the induced draft blower speed 61 drops to its low value, and the gas valve function 62 drops to its low value. At this time, the flame signal voltage 63 provides a slight increase at 74, or no increase whatsoever, indicating that the flame rod 22 is detecting a proper flame. The slight increase or no decrease in voltage proves that the induced draft blower is at the low speed setting.

As indicated by a break in the curve at this point, the system is in a state of operation that could be maintained if the low fire condition would satisfy the demand for heat. Only one additional point in the curve will be specifically referenced as it further identifies how the unique flame rod positioning and flame signal can be used to sense the status of the flame. At the point 75 in the flame signal voltage 63, a check of whether the stack 20 has been blocked is undertaken in order to meet American Gas Association and Underwriter's Laboratories test requirements. In systems of the type disclosed in FIG. 1, some type of test must be made to make sure that the stack has not become blocked, and this test is normally run periodically. In the present system, the induced draft blower speed 61 is increased to its high state, and the pressure switch output function 60 also rises to its high state. At this same time, the gas valve function 62 is maintained at a low level of operation, and the flame voltage 63 is shown to take a very slight drop at 75. This slight drop at 75 reflects the change in secondary air flow, and the decrease in flame voltage as is sensed by the flame rod 22 as shown at 75. Without this change in voltage at 75, there would be an indication that the stack was blocked or partially blocked. One further point that will be specifically mentioned is that if the flame signal voltage 63, as shown at 75, drops as indicated at 76, it is assumed that the induced draft blower speed has fallen indicating a blower failure, and the flame voltage from the flame rod 22 would drop significantly and become unstable. The microcomputer or microprocessor control device 45 would sense this as an unsafe condition and respond appropriately. It is believed that the balance of the control sequence as disclosed in FIG. 3 is basically self-explanatory when the text accompanying each of the portions of the sequence are considered with the previous description and with the flowchart that follows as FIG. 4.

In FIG. 4 is a flowchart of a system having the control sequence generally described in FIG. 3. A thermostat 80 requests heat at which time the safe start check pressure switch test for air supply begins at 81. This corresponds with the beginning of the time sequence 64 of FIG. 3. A prepurge 82 corresponding to 66 in FIG. 3 is provided and then the gas valve 14 is checked at 83 to determine if it is leaking. If the valve is leaking, a flame signal count detects the valve is leaking. A leaky valve will have a different flame signal count than a valve that is not leaking, and if the valve is leaking at 84, the system will shut down. If it is not leaking at 85, the system will continue with its attempt to prove the ignition sequence which corresponds to 67 of FIG. 3. The ignition proved at 85 then allows the system to go into its antirust cycle at 87. The antirust cycle is a high fire cycle in order to ensure that a minimum amount of damage by condensation occurs within the furnace by raising the furnace temperature.

After the antirust cycle 87 is accomplished, the system progresses at 88 to establish a reference signal level for the flame signal voltage 63 of FIG. 3. This reference arrangement provides the microprocessor 45 with information which it uses to determine when the system is in fact operating properly. The system then goes on at 89 to a low gas condition and a delay of 10 seconds, where at 90, proof of low gas and a decrease in the flame signal count by 16 of a possible 255 counts (of a flame signal analog-to-digital counting function) is created to establish whether the system is in a high fire or low fire state. The functions 88, 89, and 90, as indicated at 91, form a check for the high gas operator failure of the valve 14. This provides a check for possible failure in the gas valve 14 before the system goes either into the high fire or low fire operation.

The normal sequence would be for the system to go to the low air at 92 and, at 93, to a high fire state if a time limit has been exceeded wherein the thermostat has not been satisfied. The system then operates operates to a low air supply failure check at 94 by comparing the flame signal count again and wherein an increase by 40 counts out of 255 would indicate the line of demarcation between the YES and the NO outputs of the decision block 94.

The flow of function then is to block 95 which is the blocked stack check which occurs at five-minute intervals and forms part of a check for the blocked stack or high gas position failure as indicated at dashed box 96. After the blocked stack check at 95, the reference level of the flame is again provided at 97. At 98 the high air is set and proved and at 98 a 10-second delay is provided. Block 100 determines whether a decrease of four counts out of the 255 has occurred. If less than that decrease has occurred, the system can go into high fire indicating that the stack has not been blocked.

It will be noted that the high fire system is summed at 101 and is followed at 102 indicating that high fire air is available and checked at 103. The check of the pressure switch proves the air has been accomplished, and at 104 high gas is admitted by the opening of valve 14. The system continues to operate til 105 when the thermostat 80 is satisfied and the system shuts down.

Basically, the flowchart of FIG. 4 is self-explanatory and requires no further specific comments. The flowchart of FIG. 4 taken along with the graph of FIG. 3 provides a complete explanation of how an integrated control system for a furnace 10 would function with a microcomputer 45 wherein the flame signal from the flame rod 22 is one of the key controlling elements.

The present application has shown one specific application of a unique flame rod sensing system where the rod is exposed to and is responsive to the flame of a secondary nature in a burner that has both a primary air supply for the burner and a secondary air supply for the burner. The flame rod 22 provides a signal on conductor 30 that functions as an indication of the secondary air combustion and its changes. These types of changes do not occur, in measurable levels, in the primary portion of the burner flame which is provided only by the primary air induced into the burner at the intake cone 17. The specific sequence disclosed in FIGS. 3 and 4 is a typical sequence for an integrated control system for an induced draft blower, and in no way forms a limitation as to the use of the present invention. The present invention could be adapted to operate burners in many different sequences, and the scope of the appended claims are intended as the sole limitation on the scope of the invention.

The embodiments of the invention in which an exclusive property or right is claimed are defined as follows:

1. A flame sensing system adapted to control a fuel burner in a furnace which includes a fuel supply means to vary a supply of fuel between a low flow rate and a high flow rate, and air source means adapted to vary a supply of combustion air to the burner between a high flow rate and a low flow rate, including: a flame rod positioned to be in an outer area of a flame present at said burner when said burner is in operation; flame sensing circuit means adapted to be energized by a source of voltage; and said flame sensing circuit means connected to said flame rod and said burner to provide a flame rectified sensing signal that varies with the rate of fuel being burned and connected to said fuel supply means and said air source means to control said fuel supply means and said air source means between said high flow rates and said low flow rates.

2. A flame sensing system adapted to control a fuel burner in a furnace which includes a fuel supply means to vary a supply a fuel between a low flow rate and a high flow rate, and air source means adapted to vary a supply of combustion air to the burner between a high flow rate and a low flow rate, including: a flame rod positioned to be in an outer area of a flame present at said burner when said burner is in operation; flame sensing circuit means adapted to be energized by a source of voltage; said flame sensing circuit means connected to said flame rod and said burner to provide a flame rectified sensing signal that varies with the rate of fuel being burned and connected to said fuel supply means and said air source means to control said fuel supply means and said air source means between said high flow rates and said low flow rates; and integrated furnace control system means connected to said flame sensing circuit, said fuel supply means, and said air source means to control said fuel burner, in part, in response to said flame rectified sensing signal.

3. A flame sensing system as described in claim 2 wherein said source of voltage is an alternating current voltage.

4. A flame sensing system as described in claim 3 wherein said furnace includes pressure sensing means for sensing the pressure within said furnace and having an output; and said integrated furnace control system means includes an established sequence of control for said furnace; said integrated furnace control system comparing said pressure sensing means output, said supply of combustion air from said air source means, said fuel supply means, and said flame rectified sensing signal with said established sequence of control to assure proper operation of said furnace.

5. A flame sensing system as described in claim 4 wherein said integrated furnace control system includes a microcomputer for establishing said sequence of control.

6. A flame sensing system as described in claim 5 wherein said pressure sensing means is a pressure responsive switch; said supply of combustion air is provided in part by a two-speed blower; and said fuel supply means includes a two-stage gas valve.

7. A flame sensing system as described in claim 6 wherein said flame sensing circuit means includes a transformer secondary winding as part of said source of alternating current voltage; resistor means; and a capacitor in series circuit with said capacitor integrating same flame rectified sensing signal.

8. A flame sensing system as described in claim 7 wherein said flame sensing circuit further includes a diode poled to conduct said flame rectified sensing signal.

9. A flame sensing system as described in claim 6 wherein said flame sensing circuit means includes a second flame rectified sensing signal from a second flame rod position in a pilot burner.

10. A flame sensing system as described in claim 9 wherein said flame sensing circuit further includes a diode poled to conduct said flame rectified sensing signal.

* * * * *